US006095881A

United States Patent [19]

Neubauer

[11] Patent Number: 6,095,881

[45] Date of Patent: Aug. 1, 2000

[54] WAKEBOARD BINDING AND SYSTEM WITH BASELESS BEAM SUPPORT

[75] Inventor: Jason S. Neubauer, Redmond, Wash.

[73] Assignee: Earth & Ocean Sports, Inc., Hyannis, Mass.

[21] Appl. No.: 09/375,639

[22] Filed: Aug. 17, 1999

[51] Int. Cl.[7] ..... B63B 35/85

[52] U.S. Cl. ..... 441/70

[58] Field of Search ..... 441/70, 65, 74; 114/39.19, 363; 280/607, 617, 618

[56] References Cited

U.S. PATENT DOCUMENTS 4,758,191 7/1988 Ackert et al. ..... 441/70

5,624,291 4/1997 McClaskey .

5,868,594 2/1999 Vukelic et al. .

*Primary Examiner*—S. Joseph Morano

*Assistant Examiner*—Patrick Craig Muldoon

*Attorney, Agent, or Firm*—Richard P. Crowley

[57] ABSTRACT

A wakeboard binding and system with a baseless beam support. The binding includes a shaped metal or plastic beam, bent or formed to define a baseless U-shaped cavity between the beam sides. The baseless beam support secures, by fasteners, the sheet material to form the boot enclosure between the upper inner flange of the beam and lower separate strips.

11 Claims, 5 Drawing Sheets

WAKEBOARD BINDING AND SYSTEM WITH BASELESS BEAM SUPPORT

BACKGROUND OF THE INVENTION

A wakeboard is a recreational-type board or water ski designed to be towed behind a power boat or jet ski apparatus.

Wakeboard bindings are foot bindings designed to be employed on wakeboards, typically in pairs and securely mounted, generally angularly transversely, on the top surface of the wakeboard.

Wakeboard bindings are described in U.S. Pat. No. 5,624,291, issued Apr. 29, 1997, and another in U.S. Pat. No. 5,868,594, issued Feb. 9, 1999, both hereby incorporated by reference.

Such wakeboard bindings generally include a thin, flat, lightweight, e.g., stamped aluminum, bottom support plate with arcuate sides having fastener holes on one side and fastener slots on the other side to permit the wakeboard binding to be adjustably secured, in a selected place, to the top surface of the wakeboard.

The support plate has interior sides and industry-accepted apertures used to secure the ends of the overlay (optional), heel, and toe sheet materials to the top surface of the support plate. Side clamps and horseshoe-type clamps and stiffeners are fastened on top of the sheet materials to provide a boot-like enclosure for the foot of a user.

It is desirable to provide an improved wakeboard binding and system with enhanced stiffness and construction; improved overlay, heel, and toe fastening; a cleaner look; and improved construction and efficiency in manufacture and use.

SUMMARY OF THE INVENTION

The invention relates to a wakeboard binding, a baseless beam support used in the binding, and a wakeboard binding system.

The baseless beam wakeboard support is adapted for use in a wakeboard binding having heel and toe sheet materials to form a boot-like foot enclosure for a user, which support comprises a generally Z-shaped, right-angled, inverted beam with an upper, inward, horizontal side, with a lower surface and defining a U-shaped, interior cavity and vertical side with a lower edge. The beam has generally arcuate-shaped first and second sides extending horizontally outwardly on opposing sides from the lower edge of the vertical sides; a plurality of spaced-apart apertures in the horizontal sides of the beam; and a plurality of apertures in the arcuate sides adapted to permit the use of fasteners to fasten the arcuate sides through the apertures in a selected use position on the top surface of a wakeboard binding. The beam includes flat strips with a plurality of spaced-apart apertures which generally mimic the apertures of the horizontal sides and heel and are arranged and constructed to secure between the strips and the lower surface of the horizontal side of the overlay, or heel, or toe sheet materials, or any combination thereof.

Further, the wakeboard binding comprises the support as described with a cushioned foot pad within the U-shaped cavity for the foot of a user on a thin support plate secured to the lower surface of the beam; and heel and toe sheet materials having ends which form, in combination, a fastened adjustable, boot-like enclosure for the foot of a user; and threaded or other fasteners to fasten the ends of the sheet materials which extend within the cavity between the lower surface of the horizontal sides and the underlying flat strip.

It has been discovered that the employment of a baseless beam support for use in wakeboard bindings provides significant advantages over the prior art use of thin, stamped aluminum plates.

The raised beam construction defines the central or generally U-shaped cavity, providing for enhanced and generally uniform stiffness to the binding from the heel to the toe. Typically, the beam is extruded of a light-weight metal, such as, for example, extruded aluminum or aluminum alloy or formed of a synthetic polymeric material.

It has been found that prior art thin, flat, aluminum support plates often are flexed or bent in use by the tendency of the heel of the user to lift when a user rider bends forward, and thus, placing force on the heel portion of the flat support plate. The beam-type construction of the baseless beam support provides improved strength and stiffness to the support.

The baseless cavity formed by the beam construction provides for the use of a full footpad, and particularly, for the easy replacement of the footpad. The baseless cavity permits the use therein of certain formed and designed footpads of cushioned elastomeric, rubber or foam materials, or layered combinations thereof within the U-shaped cavity.

The baseless cavity and the beam construction also provide for a different manner and construction of securing the ends of the overlay, heel, and toe sheet materials to the baseless support, which gives the wakeboard binding a more secure and a cleaner, less cluttered, aesthetic look.

The ends of the sheet materials, rather than being fastened by bolts or screws to the top surface of a support plate with clamps or high or low rise stiffeners secured on the top (see, for example, FIG. 2 of U.S. Pat. No. 5,624,291), which often pinch the sheet material on fastening, are extended under the horizontal beam top and within the cavity, and fastened between the lower surface of the underside of the horizontal sides on each side, and on the closed back between an underlying, integral U-shaped strip, which mimics the horizontal side.

The support may comprise two flat side support strips with apertures defined by the apertures of the top flange and a bent or arcuate flat heel strip with fastener apertures. The sheet materials extend inside the U-shaped cavity, adjacent the inner sides of the horizontal sides. This arrangement avoids the necessity of matching up the holes in the center of the prior art support plates with the holes in the sheet materials and avoids pinching the sheet material.

The beam employed is described for the purposes of illustration and explanation of a right-angled, Z-shaped beam, which is shaped like an inverted L in cross-section; however, with the arcuate sides, the beam constructed can be a right-angled beam or an I-beam may be employed, or any metal or hard plastic flange beam with an inner and outer flange extending from a vertical wall. The use of an inverted L-beam is intended to cover a variety of generally right-angled beam constructions, which can provide the advantage of the inversion when formed, fabricated, or extruded to form an internal footpad cavity, between the opposing raised beam sides.

The invention includes a wakeboard binding with a baseless beam support. The binding typically includes a footpad and plurality of formed sheet materials, generally elastomeric, and often a two-layer, laminated foam sheet. One sheet material forms a curved heel enclosure which is shaped to receive the heel of a user; while another sheet material forms an arch for the forefoot and toe enclosure. Optionally, a further sheet material forms an overlay binding over the toe enclosure and extends to the heel piece. The sheet materials used may be made of the same or different sheet materials. The sheet materials form a boot-like enclosure for the foot of a user and have apertures at the one end for the heel pieces, apertures at both ends for the toe enclosure, and apertures at both ends for the overlay binding, so that the ends may be secured with fasteners to the support. Generally, the threaded, boot-like enclosure includes a footpiece of cushion or foam material adhesively secured on a thin, aluminum footpad support secured to the bottom of the beam in the bottom of the boot enclosure for the foot of a user.

The baseless beam support provides for the securing of the apertured ends of the sheet materials and the edges of the footpad between the upper flange and the lower flat strips to form a boot-like, cushioned enclosure for the foot of a user.

The wakeboard binding system comprises a pair of baseless beam support wakeboard bindings which are adjustably and removably secured with threaded fasteners, typically parallel and spaced-apart, and at an arcuate angle to the axis of the wakeboard.

The wakeboard binding includes a thin, e.g., 40 to 80 thousandths of an inch, such as an aluminum plate, threadably secured to the bottom surface of the lower flange of the baseless beam, to extend over the U-shaped cavity, and to form a platform for the support of a cushioned footpad within the cavity and also as the bottom part of the boot enclosure. The cushioned footpad is secured to the top surface of the footpad support plate, such as by adhesives, and more particularly by a double-backed, contact adhesive tape.

The wakeboard binding has been illustrated with an overlay binding; however, such an overlay binding is optional, and if used, may be secured to the support by other means than between the upper flange and the flat strip, or otherwise secured in place, if desired. Typically, and preferably, the elastomeric sheet material which form the toe enclosure and cup-like heel enclosure are secured to the baseless beam support as illustrated.

The invention shall be described for the purposes of illustration only in connection with certain illustrated embodiments; however, it is recognized that various modifications, additions, improvements, and changes may be made by persons skilled in the art without departing from spirit and scope of the invention as disclosed and claimed.

DESCRIPTION OF THE EMBODIMENTS

Figure 1:
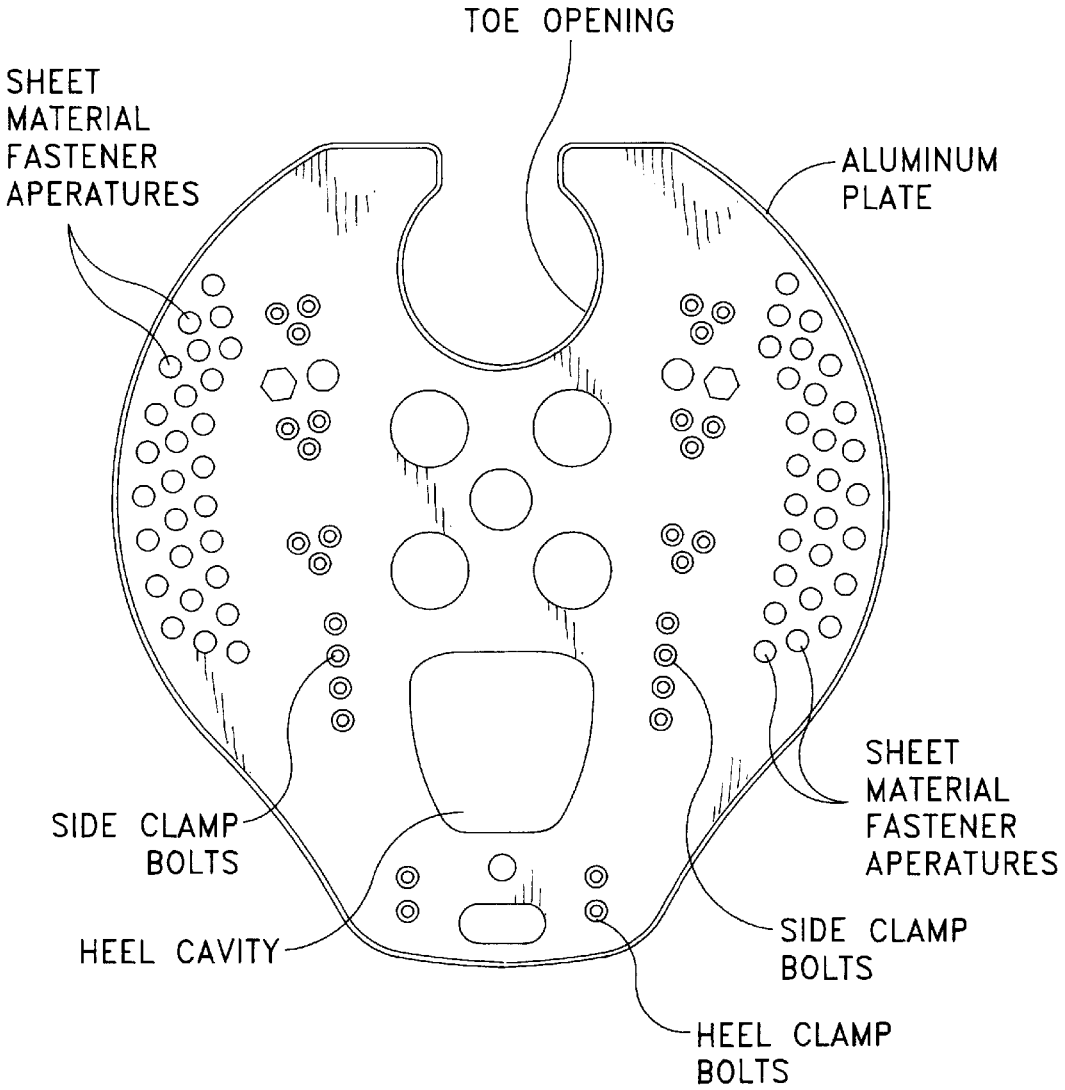
FIG. 1 (PRIOR ART)
FIG. 1 is a bottom plan view of a representative prior art flat support plate used in a wakeboard binding.

FIG. 1 shows a bottom plan view of the prior art support plate of the wakeboard binding described U.S. Pat. No. 5,858,594. The baseless beam construction of the invention is designed to replace this support plate in a wakeboard binding. U.S. Pat. No. 5,868,594 (FIG. 2) shows the prior art support plate, while exploded view FIG. 4 illustrates the manner in which the overlay, heel, toe, and foot cushioned material are secured and placed on the support plate.

Figure 2:
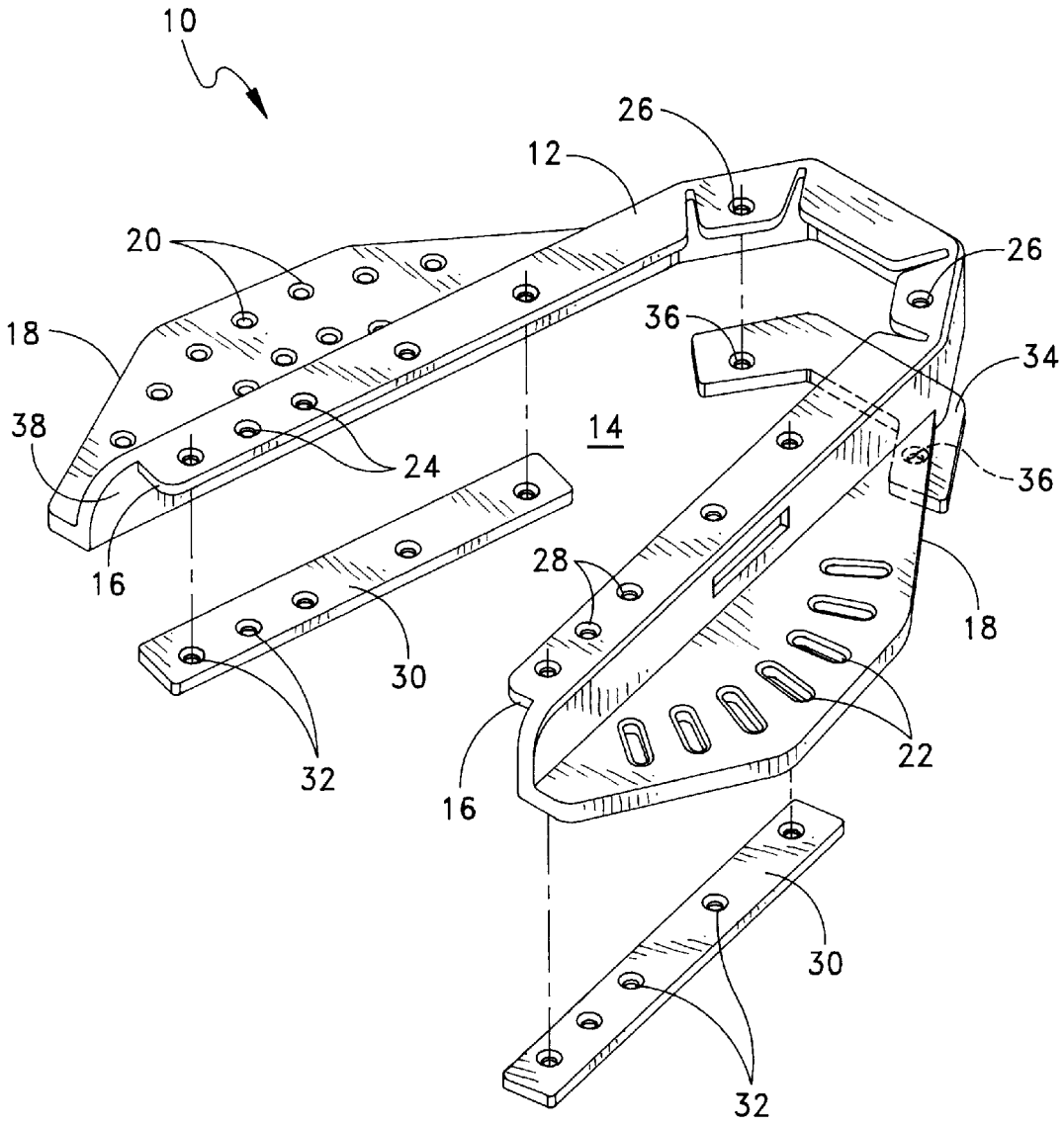
FIG. 2 is a perspective and exploded view from above of the baseless beam support of the invention and support fastening strips.
Figure 3:
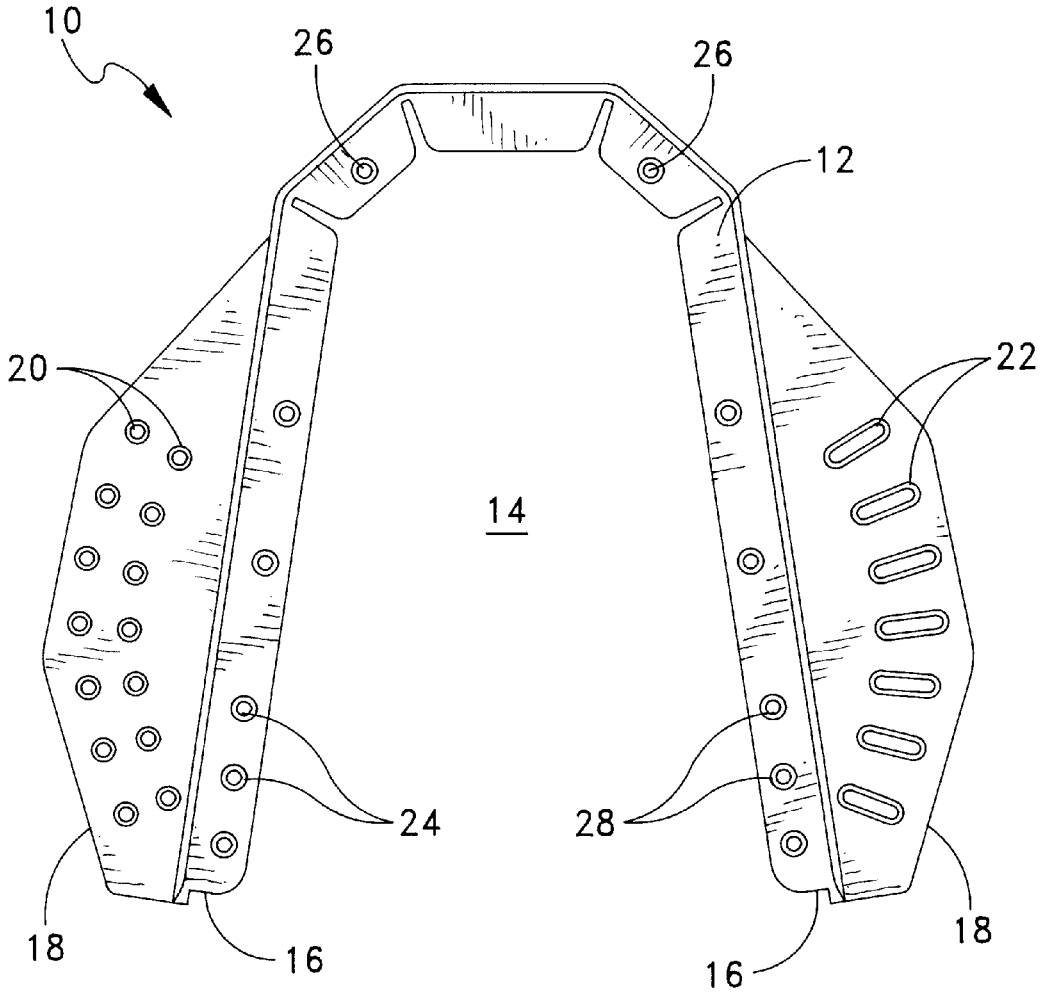
FIG. 3 is a top plan view of the support of FIG. 2.
Figure 4:
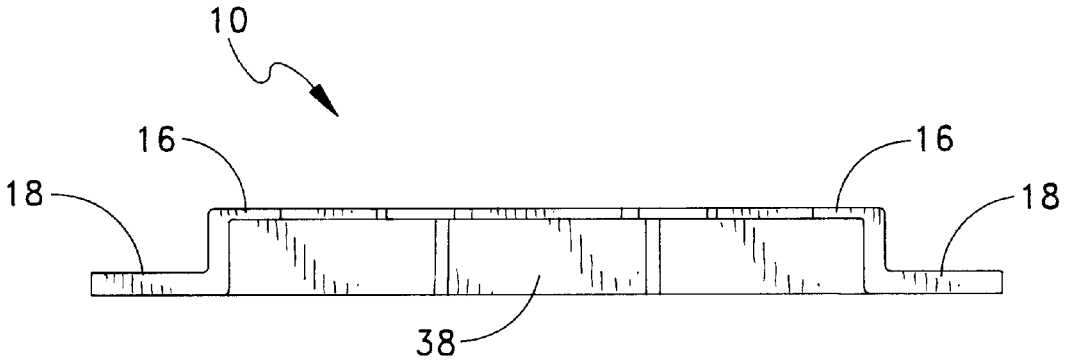
FIG. 4 is a front plan view of the support of FIG. 2.

FIGS. 2, 3, and 4 show the baseless beam support 10 of the invention as an extruded or formed metal, e.g., aluminum or plastic beam 12 in a generally U-shaped form to define an internal, U-shaped cavity 14 with an open, front toe end. The beam 12, in cross-section (an inverted L or Z-beam or truncated I-beam), has a vertical wall 38 and an inner, top extended flange 16 on either side, with fastener apertures 24 and 28, and rear or heel fastener apertures 26.

The beam 12 includes a lower, arcuate-shaped, outer, extended flange 18 with circular fastener apertures 20 on one side and slotted fastener apertures 22 on the opposite side for position adjustment of the wakeboard binding on the wakeboard. The support 10 includes separate, flat, fastener side strips 30 with apertures 32 to match the respective, side flange apertures 24 and 28 and a separate arcuate or bent flat heel strip 34 with matching heel apertures 36. It is recognized that the flat strips 30 and 34 may be replaced with an integral, U-shaped flat strip, which is shaped like the beam, for the same purpose.

In use, the sheet material of the wakeboard binding forms the heel enclosure, toe enclosure, and the overlay binding, which define the boot enclosure of the binding, which has the apertured ends of the sheet material secured between the top flange 16 and the flat support strips 30 and 34 by fasteners 44.

Figure 5:
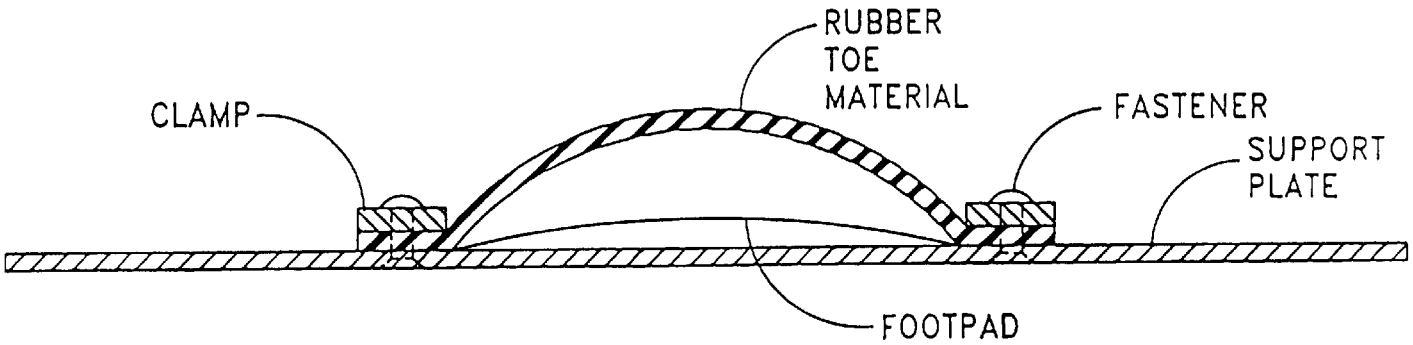
FIG. 5 (PRIOR ART)
FIG. 5 is an illustrative, front plan view of a prior art support plate and toe material fastened to the plate.

FIG. 5 shows a prior art (see U.S. Pat. No. 5,624,291) technique and construction of fastening a rubber toe sheet material to form the toe of the boot to the flat support plate.

Figure 6:
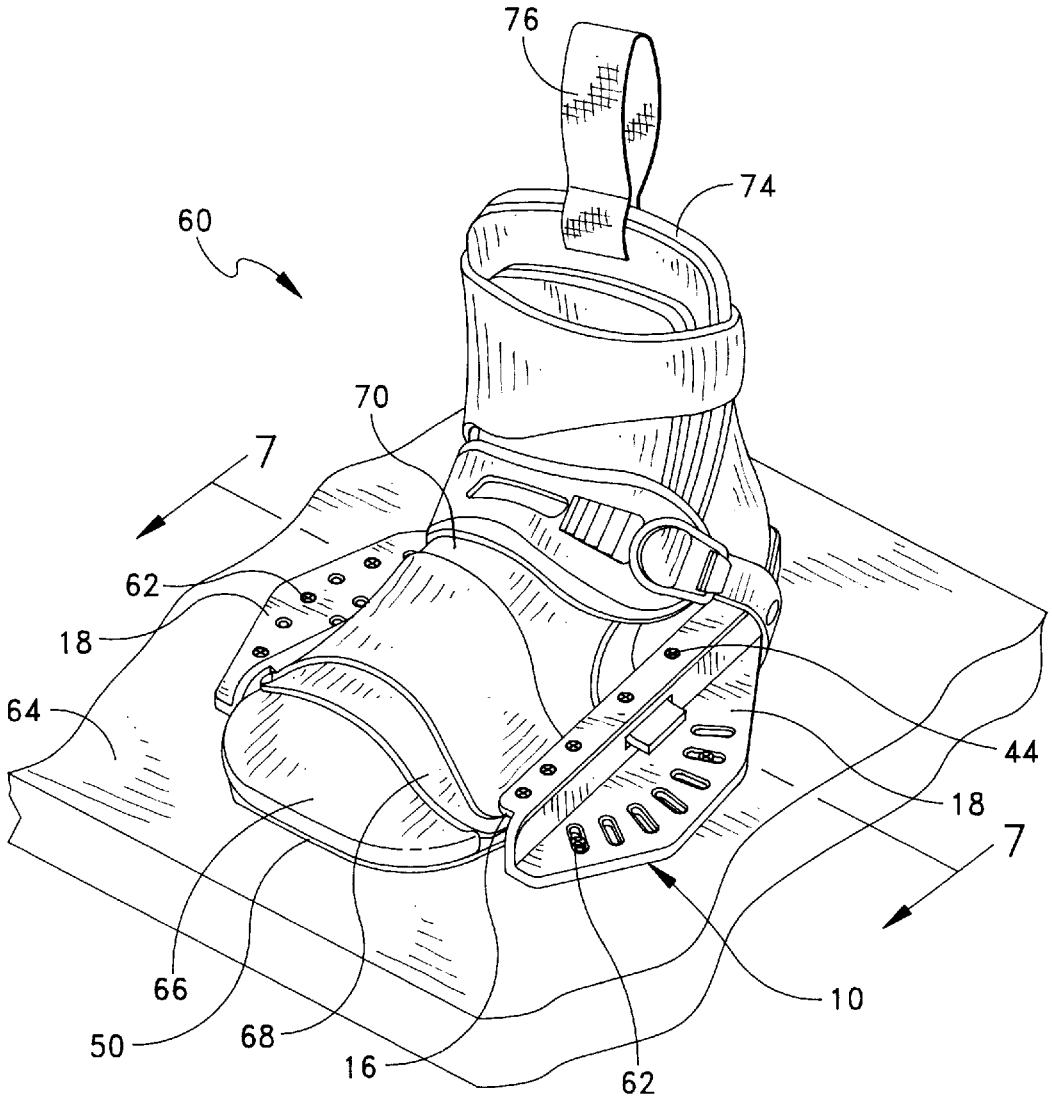
FIG. 6 is a perspective top view of a wakeboard binding with the baseless beam support on a wakeboard.

FIG. 6 is a perspective view from above of a wakeboard binding 60 employing a baseless beam support 10 fastened by threaded fasteners 62 on a wakeboard 64.

As illustrated, a cushioned foam footpad 66 and the lower edges of the angled sheet material form the toe enclosure 68 and the overlay binding 70 and the lower edges (not shown) of the formed sheet material of the heel enclosure 74 with pull-on strap loop 76 are threadably secured by fasteners 44 between the flat strip 30 and the upper flange 16.

Figure 7:
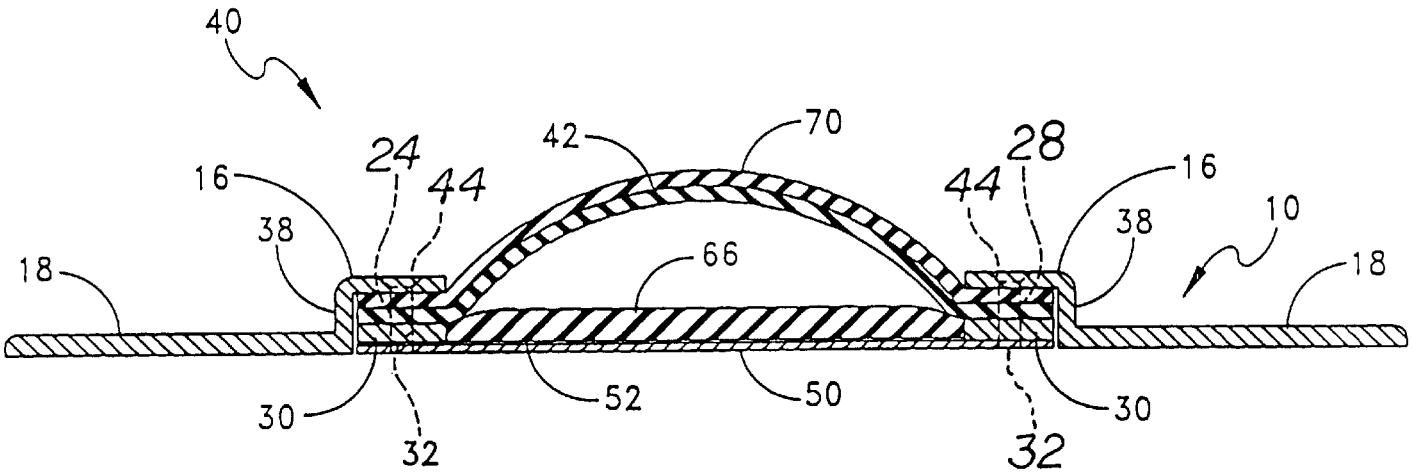
FIG. 7 is an sectional view along line 7—7 of FIG. 6 of the baseless beam support of the invention and materials fastened to the support.

FIG. 7 shows the inventive technique and construction 40 of fastening the edges of the rubber toe sheet material 42 and overlay 70 to the flanged sides 16 of the baseless beam support 12. The footpad 66 is adhesively secured by double-backed adhesive tape 52 to a footpad support plate 50, which is threadably secured to the side bottom flange 18. The sheet materials 42 and 70 are fastened securely between the lower surface of flange 16 and the upper surface of the support strips 30 by threaded fasteners 44. Thus, the baseless beam support provides a novel and effective support for a wakeboard binding.

What is claimed is:

1. A baseless beam wakeboard support adapted for use in a wakeboard binding having a boot enclosure for the foot of a user, which is formed from sheet materials, which support comprises:

a) a right-angled beam having a generally U-shape to define a U-shaped, foot-size cavity with an open toe end and closed heel end and generally opposing, spaced-apart, vertical side walls and an end wall; the beam having an upper, inwardly horizontal, extended flange from the vertical wall, with a plurality of spaced-apart, first fastener apertures and having a lower, outwardly horizontal, extended side flange of a generally arcuate shape from the vertical side walls with a plurality of spaced-apart second fastened apertures;

b) one or more flat strips with fastener apertures that mimic the first apertures; and c) a plurality of first fasteners to secure the sheet material between the flat strips and a lower surface of the upper flange.

2. The support of claim 1 wherein the support beam comprises aluminum.

3. The support of claim 1 wherein the support beam and the arcuate sides are of an integral formed material.

4. The support of claim 1 wherein the flat strip comprises an integral formed, U-shaped, flat strip which mimics the shape of the support beam strip.

5. The support of claim 1 wherein the second apertures on one side are circular apertures, and the apertures on the opposite side are slots to permit adjustment of the wakeboard binding to the wakeboard.

6. The support of claim 1 wherein the flat strips comprise a pair of straight-sided strips and an arcuate heel strip.

7. A wakeboard binding which includes the beam support of claim 1.

8. A wakeboard binding which comprises:

a) the support of claim 1;

b) a thin, footpad support plate secured to the bottom of the baseless beam support;

c) a cushioned footpad secured to the top surface of the footpad plate and within the U-shaped cavity for the foot of a user;

d) heel and toe sheet materials having ends which form, in combination, a fastened, adjustable boot enclosure for the foot of a user; and e) the ends of the sheet materials fastened in a fastened arrangement between a lower surface of the upper flange and the flat strip.

9. The wakeboard binding of claim 8 which includes the footpad secured to the footpad support by double-backed adhesive tape.

10. The wakeboard binding of claim 8 which includes an overlay binding of sheet material secured between the flange and flat strip.

11. A wakeboard system having a top surface and which comprises a pair of spaced-apart wakeboard bindings of claim 8 secured to the top surface.

* * * * *